United States Patent [19]

Haney

[11] Patent Number: 4,587,907

[45] Date of Patent: May 13, 1986

[54] RAILROAD TIE TRANSPORT CAR

[75] Inventor: T. L. Haney, Jackson County, Mo.

[73] Assignee: The Kansas City Southern Railway Company, Inc., Kansas City, Mo.

[21] Appl. No.: 469,152

[22] Filed: Feb. 24, 1983

[51] Int. Cl.[4] ..... B61D 3/08; B61D 17/08

[52] U.S. Cl. ..... 105/378; 105/258; 105/380; 296/36

[58] Field of Search ..... 105/258, 259, 355, 363, 105/378, 379, 380; 296/32, 34, 36, 42; 104/5, 6; 248/214, 228, 72; 410/77, 81, 93

[56] References Cited

U.S. PATENT DOCUMENTS

| | | | |
|---|---|---|---|
| 503,874 | 8/1893 | Pratt | 105/378 |
| 688,777 | 12/1901 | Hansen | 105/379 |
| 855,943 | 6/1907 | Frame | 105/258 |
| 985,926 | 3/1911 | Otis | 105/378 X |
| 2,299,968 | 10/1942 | Dietrichson | 105/355 X |
| 2,623,089 | 12/1952 | Greene et al. | 248/72 |
| 2,994,285 | 8/1961 | Dunlap | 105/355 |
| 3,162,145 | 12/1964 | Franklin et al. | 105/258 X |
| 4,416,484 | 11/1983 | O'Neill | 105/380 X |

FOREIGN PATENT DOCUMENTS

| | | | |
|---|---|---|---|
| 434213 | 9/1926 | Fed. Rep. of Germany | 105/379 |
| 748876 | 11/1944 | Fed. Rep. of Germany | 105/380 |

*Primary Examiner*—Robert B. Reeves
*Assistant Examiner*—Dennis C. Rodgers
*Attorney, Agent, or Firm*—Kokjer, Kircher, Bradley, Wharton, Bowman & Johnson

[57] ABSTRACT

This invention relates to a railroad car for use in transporting railroad ties. A flat bed is provided with siderails which extend upwardly along each side of the bed. Each of the siderails comprises vertically extending posts and horizontally extending rails with some of the rail sections being removable to accommodate unloading of the ties. The removable rail sections are disposed so that upper and lower rails on one sidewall are removable while an intermediate rail section on the opposite sidewall is removable. This helps to insure the structural integrity of the car.

13 Claims, 3 Drawing Figures

RAILROAD TIE TRANSPORT CAR

This invention relates generally to railroad cars and, more particularly, to a car especially designed for handling railroad ties.

It is, of course, well known to utilize large timbers commonly referred to as ties to secure rails to a bed to form a railroad track. Replacement of railroad ties is a continuous job which all railroads must perform. Railroad ties are normally carried from the supply yard along the line to a location where they are needed. Because of the nature of railroad ties, they are normally transported on flat cars having sidewalls or rails to hold the load. When the location is reached where the ties are needed, they are normally thrown over the sidewalls of the car by workers to first one side of the track and then the other. It is, of course, possible to use mechanical lifts for unloading the cars, although this is generally more time consuming and not economically efficient since this type of cargo can be unloaded by manual labor.

It is, however, very demanding work to unload railroad ties by hand and, in some cases where workers do not follow recommended safety procedures, back strains have been known to occur.

It is, therefore, a primary object of the present invention to provide a railroad car especially designed for hauling railroad ties which has removable side panels to permit the ties to be unloaded without the need to lift the ties over the sidewalls of the car.

As a corollary to the above object, an important aim of the invention is to provide a railroad car especially designed for handling railroad ties which makes unloading of the ties safer and faster than manual unloading methods heretofore utilized.

It is also an object of the invention to provide a railroad car having removable side panels to accommodate unloading of ties from the car and where the sidewalls are constructed in such a manner that the removable panels do not jeopardize the structural integrity of the car.

Still another one of the objectives of my invention is to provide a railroad car of the type meeting the foregoing aims and objects which provides a quick release mechanism for the removable side panels.

Other objects of the invention will be made clear or become apparent from the following description and claims when read in light of the accompanying drawing wherein:

Figure 1:
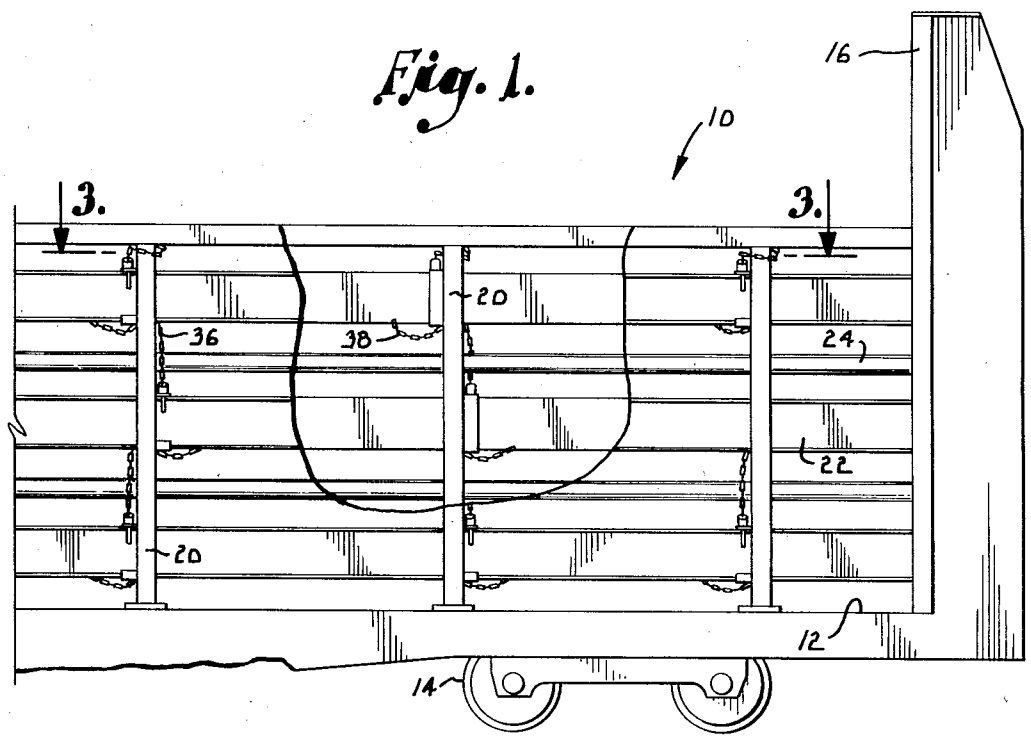
FIG. 1 is a side elevational view, partly broken away, of a railroad car according to the present invention.
Figure 3:
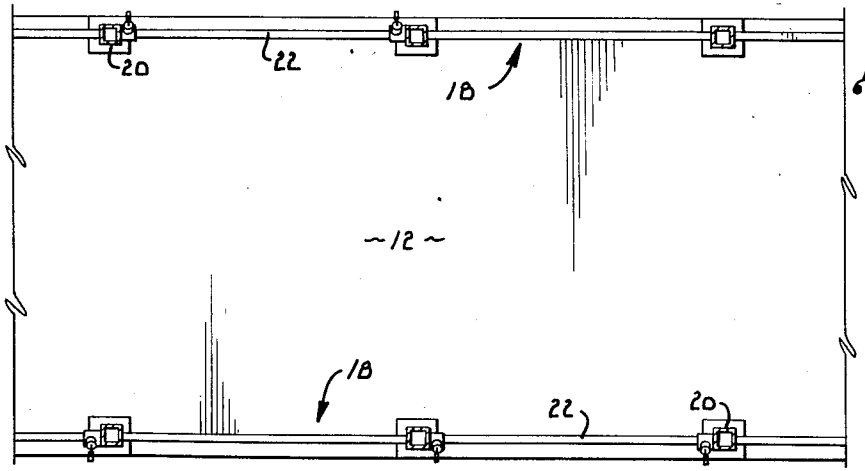
FIG. 3 is a horizontal cross-sectional view of the railroad car of the present invention taken along line 3—3 of FIG. 1.

Referring initially to FIG. 1, a railroad car according to the present invention is designated generally by the numeral 10. Car 10 comprises a flat bed 12 mounted on wheel and axle assemblies 14. Extending upwardly at both of the ends of car 10 are bulkheads 16. Extending between the bulkheads on opposite sides of bed 12 are first and second siderails designated generally by the numeral 18. As both siderails are identical, only one will be described in detail.

Each siderail 18 comprises a plurality of spaced apart vertically extending upright posts 20 and a plurality of horizontally extending spaced apart rails 22 and 24. Rails 22 and 24 extend between adjacent posts and between the end posts and the bulkheads 16. A cap rail 25 runs the length of bed 12 along the tops of posts 20.

Figure 2:
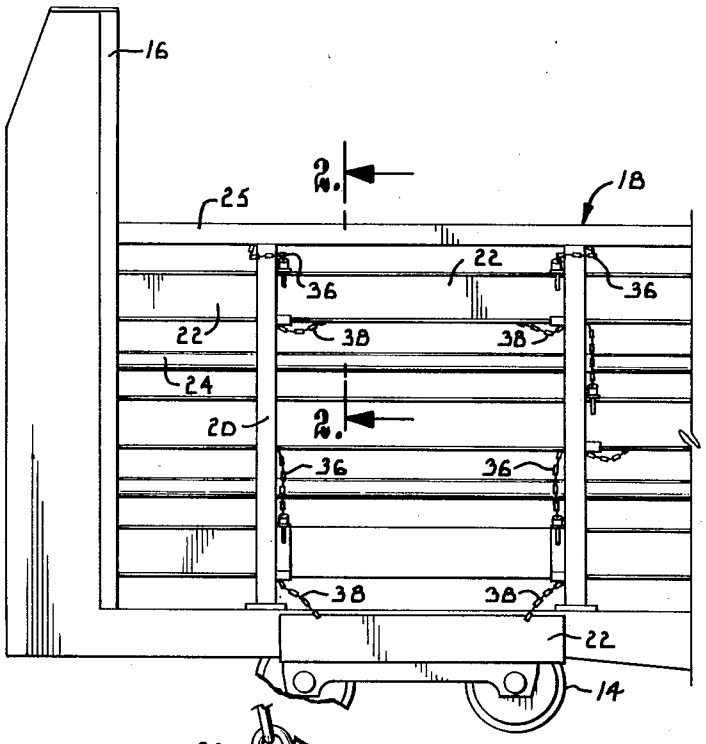
FIG. 2 is a fragmentary cross-sectional view taken generally along line 2—2 of FIG. 1.
Figure 2:
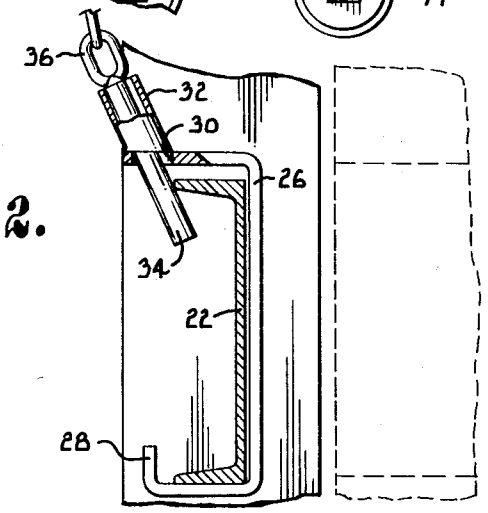

Some of the rail sections 22 are removably mounted between adjacent posts 20 by means of u-shaped brackets 26 (FIG. 2). Brackets 26 are rigid with posts 20 and each of the brackets is provided with a lip 28 for retaining one end of the removable rail section 22. The opposite end of bracket 26 is provided with a through opening 30 and an integral sleeve 32 aligned with and extending upwardly from the opening. It is to be noted that sleeve 32 is disposed at a slight acute angle relative to the vertical plane of rail 22.

The sleeve receives a keeper pin 34 which is welded at one end to a retaining chain 36. Chain 36 is in turn welded at its opposite end to the adjacent post 20.

It is to be noted that the brackets 26 and their associated retaining pins 34, which removably mount selected rail sections 22, are disposed so that upper and lower rail sections between adjacent posts on one sidewall are removable while another removable rail section on the opposite sidewall is disposed at a vertical height intermediate the upper and lower removable sections on the first sidewall. At a point spaced lengthwise from these first removable sections, the first sidewall will have a removable rail section which is at a height intermediate upper and lower removable rail sections on the opposite sidewall. In this manner, the removable sections are alternated in positions along the length of the car so as to maintain the structural integrity of the sidewalls. It is also to be amphasized that, while at least one removable section has been shown in the drawing between each adjacent pair of posts 20, this has been done only to illustrate the pattern for locating the removable sections. In actual practice, it would not be necessary in many instances to have a removable section between each adjacent pair of posts and one or more sections between adjacent posts could be without any removable sections. Manifestly, by locating the various removable sections at different heights, unloading of the railroad ties from within the car is greatly facilitated.

When railroad ties are to be unloaded, rail sections 22 are removed as necessary by simply pulling pins 34 from sleeves 32 thus freeing rail sections 22 to be removed from brackets 26. Chains 38 are welded to rail sections 22 and to posts 20 so that, once removed, the rail sections 22 can be allowed to simply hang along the side of the car as illustrated in FIG. 1. When it is time to replce the removable rail sections 22, they are placed back inside of brackets 26 and keeper pins 34 are again inserted into sleeves 32. Because sleeve 32 is disposed at an angle relative to the vertical, each pin 34 will tend to wedge itself against the upper end of rail 22 thus assuring a tight fit and also helping to retain the pin in its holding position.

While the invention has been particularly described with regard to transporting railroad ties, it will be appreciated that the railroad car may find utility in transporting other similar types of cargo.

I claim:

1. A railroad car for use in transporting cargo such as railroad ties and the like, said car comprising:

a flat bed;

a wheel assembly coupled with said bed for moving said bed over a track;

first and second siderails extending upwardly from and along opposite sides of said bed, each of said siderails comprising a plurality of spaced apart vertically extending posts and a plurality of spaced apart horizontally extending rails, said rails including upper and lower rails extending between each pair of posts and an intermediate rail extending between each pair of posts and at a location between the upper and lower rails;

means for removably mounting the upper and lower rails between two adjacent posts on said first siderail;

means for fixedly mounting the intermediate rail between said two adjacent posts on said first siderail;

means for removably mounting the intermediate rail between two adjacent posts on said second siderail which are opposite said two adjacent posts on said first siderail; and means for fixedly mounting the upper and lower rails between said two adjacent posts on said second siderail, each of said removable mounting means permitting the rail mounted thereby to be detached from its siderail to expose a space in the siderail through which the cargo can be unloaded.

2. The invention of claim 1, wherein said mounting means comprises a u-shaped bracket having a turned up lip at one end, said rail being adapted to fit behind said lip, and a removable keeper pin associated therewith at the opposite end of the lip for holding said rail.

3. The invention of claim 1, wherein is included means for removably mounting upper and lower rails between two adjacent posts on said other siderail, at a point spaced lengthwise of the car from said intermediate disposed rail, and means for removably mounting a second intermediate rail disposed intermediate and opposite said upper and lower rails on said other siderail.

4. The invention of claim 1, including:

means for fixedly mounting the upper and lower rails between two other adjacent posts on said first siderail;

means for removably mounting the intermediate rail between said two other adjacent posts on said first siderail;

means for removably mounting the upper and lower rails between two other adjacent posts on said second siderail which are opposite said two other adjacent posts on said first siderail; and means for fixedly mounting the intermediate rail between said two other adjacent posts on said second siderail;

5. A railroad car for transporting cargo such as railroad ties and the like, said car comprising:

a flat bed;

a wheel assembly coupled with said bed for moving said bed along a railroad track;

first and second sides extending upwardly from and along opposite sides of said bed;

a plurality of generally vertical posts in each side spaced apart from one another and forming sections of the sides between each pair of adjacent posts;

a plurality of generally horizontal rails in each section, including upper and lower rails extending between the posts of the section and an intermediate rail extending between the posts of the section at a location between the upper and lower rails;

means for removably mounting the upper and lower rails between the posts of preselected sections on each side;

means for fixedly mounting the intermediate rails between the posts of said preselected sections;

means for removably mounting the intermediate rails between the posts of other sections on each side; and means for fixedly mounting the upper and lower rails between the posts of said other sections.

6. The invention of claim 5, wherein said preselected sections and said other sections alternate on each side.

7. The invention of claim 6, wherein said preselected sections on said first side are located opposite said other sections on said second side and said preselected sections on said second side are located opposite said other sections on said first side.

8. A railroad car for transporting cargo such as railroad ties and the like, said car comprising:

a flat bed;

a wheel assembly coupled with said bed for moving said bed along a railroad track;

first and second sides extending upwardly from and along opposite sides of said bed, each side including a plurality of spaced apart vertically extending posts and a plurality of fixed rails extending generally horizontally between adjacent pairs of posts;

a plurality of removable rails for each side, each of said removable rails having a length to extend substantially horizontally between adjacent posts and having a major portion thereof occupying a generally vertical plane when extending between adjacent posts;

a pair of u-shaped brackets for removably mounting each removable rail in extension between adjacent posts, said brackets being secured to the posts on each side at locations to receive opposite ends of the removable rails and each bracket having a lower end presenting an upturned lip behind which the end of removable rail fits when inserted in the brackets; and a removable keeper pin for each bracket cooperating with the lip of the bracket to retain the end of the removable rail in the bracket, said keeper pin being insertable through the upper end of the bracket and being detachable therefrom to release the removable rail for removal from the side to expose a space through which the cargo may be unloaded, said keeper pin having an axis thereof disposed at an acute angle relative to said vertical plane to wedge against the removable rail upon insertion through the upper end of the bracket.

9. The invention of claim 8, wherein each keeper pin means includes an opening through the upper end of the bracket and a keeper pin insertable through the opening.

10. The invention of claim 9, including a flexible retainer for each keeper pin secured to the pin at one end and to the adjacent post at the other end to suspend the pin from the post when the pin is withdrawn from the opening.

11. The invention of claim 10, including a pair of flexible retainers for each removable rail, each retainer being secured at one end to the rail and at the other end to the adjacent post to suspend the removable rails from the posts when the rails are removed from the brackets.

12. The invention of claim 9, including a sleeve for each opening secured to the upper end of each bracket in registration with the opening, said keeper pins being insertable through the sleeves.

13. The invention of claim 8, including a pair of flexible retainers for each removable rail, each retainer being secured at one end to the rail and at the other end to the adjacent post to suspend the removable rails from the posts when the rails are removed from the brackets.

* * * * *